XR 3,973,095

X 2042C

United Sta

Greene

[11] 3,973,095

[45] Aug. 3, 1976

[54] INTRUSION DETECTOR SENSITIVE TO RESONANT FREQUENCY OF BREAKING GLASS

[76] Inventor: Ted R. Greene, 7809 Meadowbrook Court, Pleasanton, Calif. 94566

[22] Filed: June 16, 1975

[21] Appl. No.: 587,344

Related U.S. Application Data

[63] Continuation-in-part of Ser. No. 458,339, April 5, 1974, abandoned.

[52] U.S. Cl. ..... 200/61.93; 200/235; 340/274 R

[51] Int. Cl.[2] ..... H01H 3/02; H01H 29/04; G08B 13/08

[58] Field of Search ..... 200/61.84, 61.93, 293–296, 200/215–218, 188, 220, 232, 235, 61.47; 340/273, 274

[56] References Cited

UNITED STATES PATENTS

| | | | |
|---|---|---|---|
| 3,706,090 | 12/1972 | Callaghan | 200/61.84 X |
| 3,899,784 | 8/1975 | McHenry | 200/61.93 X |

*Primary Examiner*—James R. Scott
*Attorney, Agent, or Firm*—Harris Zimmerman

[57] ABSTRACT

An intrusion detector which senses the motion and vibration caused by intrusion comprises a base plate secured to the surface to be protected, and a housing coaxially and rotatably joined to the base plate. Within the housing is disposed a mercury switch parallel to the protected surface. The mercury switch comprises a tubular envelope housing a drop of mercury and a pair of electrodes. The electrodes are of disparate lengths so that the mercury must travel to one extreme end of the tube to complete the circuit. Rotation of the housing alters the orientation of the switch envelope with respect to horizontal, permitting the device to be employed as a normally-open or normally-closed motion switch. Further, the switch is sensitive to motion colinear with the axis of the envelope, so that, by rotation of the housing, its sensitivity may be finely adjusted to stimuli ranging between loud noises to broachment of the protected surface. In one embodiment the electrode structure of the switch is designed to sense the particular frequency of breaking glass, and to close when such frequency is present.

9 Claims, 9 Drawing Figures

3973095
OR IN 200/61.93

INTRUSION DETECTOR SENSITIVE TO RESONANT FREQUENCY OF BREAKING GLASS

CONTINUATION-IN-PART

This application is a continuation-in-part of application Ser. No. 458,339, filed Apr. 5, 1974, now abandoned.

BACKGROUND OF THE INVENTION

In the field of burglar alarms and intrusion detectors, the use of mercury switches for sensing a tilt condition or acceleration is well known. In these devices the switch usually comprises a drop of mercury and electrodes of equal length enclosed in a capsule with a non-corrosive atmosphere. Any sudden motion imparted to the device or change in inclination causes the mercury to run into the electrodes, closing the switch and actuating the alarm.

A major drawback to these devices is that the switch itself is not readily adjustable in sensitivity. Thus a great many false alarms may be sounded, at great expense and annoyance, or the actual alarm condition may not be sensed, at greater expense and disappointment. To remedy this situation, a great amount of effort has been expended in the prior art to design electronic systems which can discriminate with a high degree of certainty between false and true alarm indications. These systems are complex and expensive, and accordingly temperamental and difficult to service.

Another failing of the prior art devices is that in general the switches are sensitive to motion imparted from any direction. Thus a prior art device protecting a pane of glass may be actuated by the backfire of a passing automobile as well as the breaking of the pane. In another instance a mercury switch device employed to detect the motion associated with broachment or scaling of a fence may be falsely actuated by a gust of wind. These failings are both due to a lack of directional sensitivity of the prior devices.

SUMMARY OF THE INVENTION

The present invention is an intrusion detector which employs a uniquely designed mercury switch to sense the vibrations caused by unauthorized entry. The novel mercury switch in concert with other portions of the invention comprises a detector which is capable of adjustment of motion sensitivity. Further, the detector is directionally sensitive to motion, and is also easily adjustable in that respect.

The invention generally comprises a cylindrical base plate which is secured to the surface to be protected by screws or adhesive. A cylindrical housing rotatably secured to the base plate and parallel thereto has chordally disposed therein a novel mercury switch. The mercury switch includes one long and one short electrode within the tubular envelope which encloses the mercury, and is sensitive to motion or vibration which is primarily colinear with the axis of the envelope. The housing is rotated to alter the orientation of the tubular envelope, thus setting the switch as normally open or normally closed, and aligning the envelope toward the probable area of intrusion. For example, the invention employed on a corner of a window pane may be set as a normally open switch and aligned generally toward the center of the window.

Also, rotation of the housing permits a fine adjustment of the sensitivity of the switch to motion, by allowing the switch to be oriented so that the mercury either is on the verge of making or breaking the circuit, or is aligned to require conjunction with both electrodes. A set screw coaxial with the base plate and the housing is then tightened to secure the housing with the switch at the desired orientation.

It should be noted that the simple mechanical adjustment of the present invention prevents the issuance of false alarms and the malfunctions that cause missed alarms. In this respect the invention obviates the need for intricate electronic circuitry, and provides the basis for an uncomplicated, inexpensive yet effective intrusion detector and burglar alarm.

In another embodiment the switch is adapted to be activated by the particular frequency emitted by breaking glass, so that the device discriminates between noise and the sound of broachment of the protected window.

THE DRAWING

DESCRIPTION OF THE PREFERRED EMBODIMENT

Figure 1:
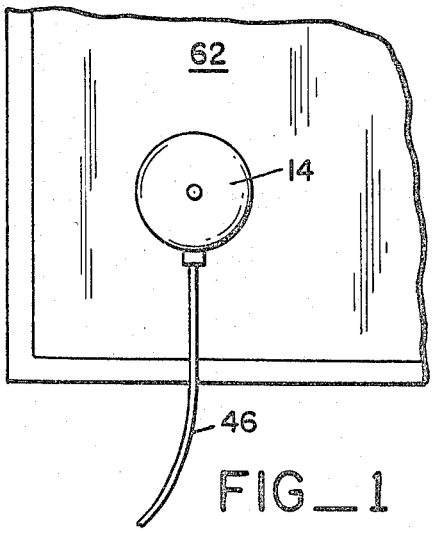
FIG. 1 is a front elevation of the present invention in use on a window pane.
Figure 2:
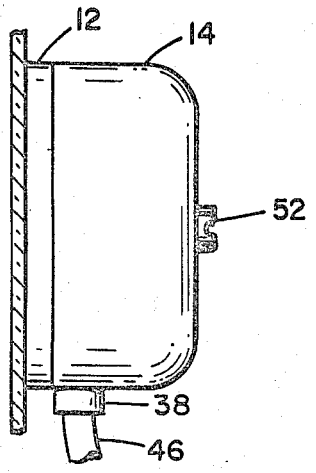
FIG. 2 is a side elevation of the present invention.

The intrusion detector of the present invention generally comprises a fixed wafer-like base plate 12 joined to a rotatable housing 14. The base plate, which may be fabricated of cast plastic or the like, is coated on one surface 16 with a contact adhesive or double-sided adhesive tape. The circumference of the base plate is provided with an annular shoulder 18 which defines a reduced diameter annulus 20. A pair of countersunk screw holes 22 extend through the plate, as does an axial hole 24. Coaxial with the hole 24 is a recess which rigidly retains a threaded nut 26.

Figure 3:
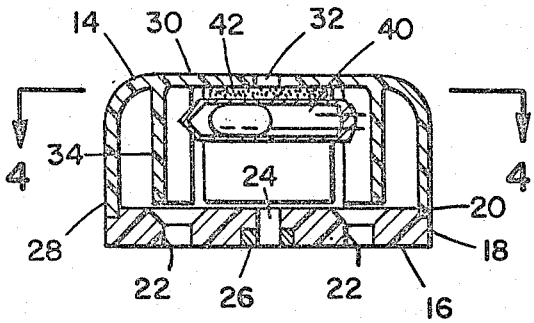
FIG. 3 is a cross-sectional side view of the switch assembly and housing shown in FIGS. 1 and 2.
Figure 4:
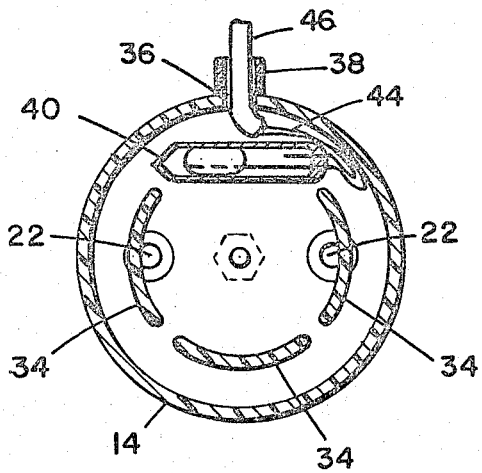
FIG. 4 is a cross-sectional front elevation taken along line 4—4 of FIG. 3.

The housing 14 comprises a cast cast plastic cylinder plastic cylinder 28 equal in diameter with the base plate, closed at one end 30 and disposed coaxially with the base plate. The open end of the housing engages the reduced diameter annulus 20 and rotates thereabout. The end 30 is provided with a coaxial screw hole 32. The end also has three integral, internal supports 34 projecting therefrom toward the base plate. These supports are arcuate segments of equal diameter, disposed non-symmetrically about the cylinder axis, as shown in FIGS. 3 and 4. The housing is also furnished with a radial hole 36 which is surrounded on the exterior by a neck 38 extending substantially radially from the housing.

Within the housing a motion-sensing mercury switch 40 is disposed chordally, parallel to the base plate. The switch is secured to the housing with adhesive 42 such as epoxy or the like, and is connected to the leads 44 of a cable 46, which extend into the housing through the opening 36. If circumstances warrant the housing may be partially or completely filled with potting material such as epoxy to make the unit rugged.

Figure 5:
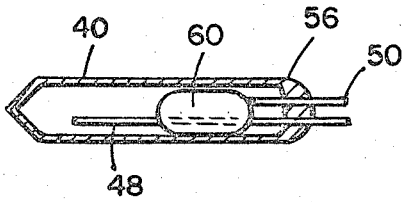
FIG. 5 is a detailed cross-sectional view of the mercury switch used within the housing assembly of the present invention.

The switch 40 includes a tubular envelope 42 of glass or the like which is sealed at both ends, as shown in FIG. 5. Extending through the glass into the envelope cavity are a long electrode 48 and a short electrode 50. Also within the envelope cavity is disposed a charge of elemental mercury 60 sufficiently large to fill a portion of the envelope. The switch is novel in that the mercury must slide along the long electrode 48 to reach the electrode 50 and complete a circuit.

The long electrode acts as a guide along which the mercury flows, so that the liquid mercury cannot slosh in the envelope cavity under the influence of random motions. That is, the long electrode permits the mercury to move to make or break contact only under the urging of vibration or acceleration which is colinear with the tubular envelope, creating a high directional sensitivity. The projections 34 act to damp out vibrations which are not coaxial with the switch, thus increasing the directional sensitivity. Further, the mercury must travel to the extreme end 56 of the envelope to make contact with both electrodes. This feature allows the switch to receive slight axial motions without causing the switch to close and give a false alarm.

Figure 6:
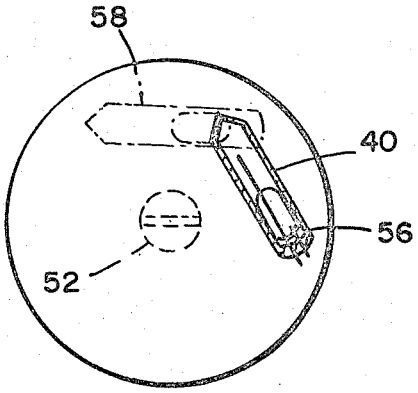
FIG. 6 is a schematic depiction of the adjustment of the present invention.

A screw 52 extends through the hole 32 along the axis of the device and is secured in nut 26. The screw may be tightened to to immobilize the housing plate, or may be loosened to permit manual rotation of the housing. With rotation of the housing the orientation of the switch may be altered in great degree to select the desired switching function. As shown in FIG. 6, the switch may be disposed substantially vertically with the end 56 below. This forms a normally closed switch sensitive to vertical motion, and is appropriate for sensing intrusion through a fence or the like.

As depicted in phantom line 58, the switch may be motion. Alternatively, the switch may be disposed as normally open and sensitive to slight lateral motion, as shown in FIG. 4. The latter orientations are appropriate for sensing the motions associated with attempted broachment of a wall or window.

A further embodiment of the present invention is designed to incorporate all of the advantages described in the foregoing, and further to employ a mercury switch and associated support structure which is particularly sensitive to the frequency of the sound of breaking glass. Research has shown that as window glass of various dimensions breaks it emits a complex tonal pattern in which a particular frequency component of approximately 9000 Hz is always present. The embodiment of FIGS. 7 and 8 is adapted to respond to this frequency component and signal an alarm condition indicating that the window to which it is secured has broken.

Figure 7:
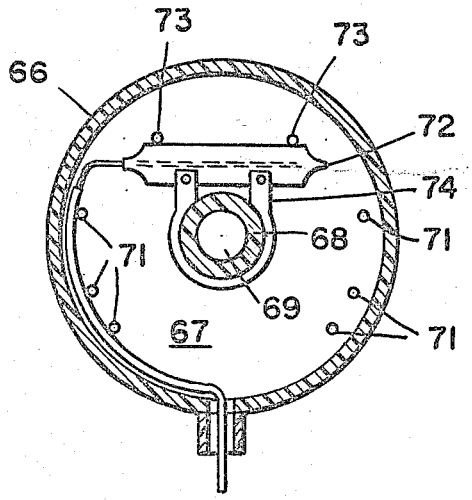
FIG. 7 is a cross-sectional elevation of a further embodiment of the present invention.
Figure 9:
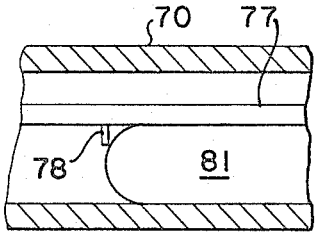
FIG. 9 is an enlarged detailed view of air electrode of the present invention.

As shown in FIG. 7, a housing 66 is provided, comprising a cast plastic member similar in shape to the housing 14, and adapted to be secured to a base plate 12 as described in the foregoing. Extending from the end 67 of the housing is a centrally disposed cylindrical boss 68 having a hole 69 therethrough adapted to receive a screw threaded into the base plate. A plurality of spaced, narrow, cylindrical fingers 71 also extend from the end of the housing, for reasons which will be made apparent in the following description. Supported on the end 67 of the housing is a frequency sensitive mercury switch 72, impinging on a pair of fingers 73 and adjacent to the boss 68. A C-clip 74 resiliently retained about the boss impinges on the mercury switch to secure it during assembly.

Figure 8:
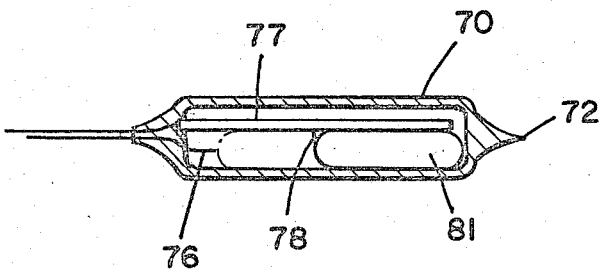
FIG. 8 is a detailed cross-sectional view of the mercury switch of the further embodiment of the present invention.

As shown in FIG. 8, the mercury switch 72 comprises a tubular envelope of glass approximately 0.75 inch (19.05 mm) long and 0.175 inch (4.44 mm) diameter. Extending into the evacuated cavity of the envelope are a pair of electrodes 76 and 77, both fabricated of copper-clad alloy lead material 52 which is vacuum melted and gas free. The short electrode 76 is 0.020 inch (0.508 mm) diameter; spaced 0.075 inch (1.90 mm) therefrom is the electrode 77 which is 0.030 inch (.762 mm) diameter and 0.50 inch (12.7 mm) long. Extending normally from a medial portion of the electrode 77 is a platinum contact spike 78. A charge of mercury 81 is disposed within the tubular cavity.

Joined to each of the external leads of the mercury switch is one conductor of a two conductor insulated cable 79. The cable is disposed between the housing wall and the fingers 71. The housing is filled with resin or plastic potting compound (not shown) to ruggedize the unit. The fingers 71 act not only as cable guides, but also as structural members which co-act with the potting compound to limit the sensitivity of the switch to low frequency vibration and shock.

The dimensions and configuration of the switch of the present embodiment enable the switch to be particularly sensitive to vibrations of approximately 9000 Hz. The device is applied to a window as described in the foregoing and shown in FIG. 1, and rotated so that the switch is approximately horizontal and the mercury is disposed in the noncontact position (solid line in FIG. 8), as explained previously. Should the window be broken the 9000 Hz vibration component of the breaking sound will cause the switch structure, and in particular the electrode 77, to resonate, causing the mercury to overcome the slight flow resistance due to contact with electrode 77, the platinum spike, and the glass, and migrate toward the electrode 76. As the mercury bridges the two electrodes contact is made and an alarm is indicated. The platinum spike decreases the contact resistance to provide a sharper alarm indication.

It should be noted that this switch structure is relatively insensitive to vibration other than the 9000 Hz component. Thus the protected window may suffer wind shock, pounding, traffic vibration, and sonic booms without the device indicating an alarm.

The device is mounted on a surface to be protected, such as the interior of a wall, window pane, ceiling, fence, door or the like, by first affixing the base plate to the surface. This may be accomplished with the adhesive 16 and/or screws received through the holes 22. The housing is then secured to the base plate with screw 52, and the cable is connected to an alarm system. The housing is thereafter rotated to set the switch function, direction of sensitivity, and degree of sensitivity, and the installation is complete, as depicted with a window pane is FIG. 1.

It may be advantageous in some environments to protect the cable of the invention from being cut by wouldbe intruders. In such circumstances the cable is provided with four conductors, two of which are connected to the mercury switch as shown. The other two conductors are connected together within the housing to form a continuous circuit which is monitored by the alarm system, as is known in the art. Should the cable be cut in an attempt to circumvent the motion-sensing switch, the monitored circuit will be opened, causing the alarm system to sound an alarm.

I claim:

1. An intrusion detector comprising a base plate, means for securing said base plate to an article to be protected, a housing rotatably secured to said base plate, a vibration sensing switch secured in said housing for sensing a particular frequency produced by the breaking of said article, said switch comprising a sealed, tubular, envelope having cylindrical evacuated cavity therein, a first electrode disposed in said cavity and extending substantially the entire length thereof, a second electrode parallel to said first electrode and disposed in one end of said cavity, and a charge of mercury disposed in said cavity.

2. The detector of claim 1, wherein said first electrode is adapted to resonate at said particular frequency and facilitate the flow of said mercury charge toward said one end of said cavity.

3. The detector of claim 1, wherein said first electrode includes a contact spike extending from a medial portion thereof.

4. The detector of claim 1, wherein said housing comprises a cylindrical member joined at one end to said base plate and closed at the other end, and including a plurality of narrow cylindrical fingers extending from said other end into said housing to reduce transmission of low frequency vibration to said switch.

5. The detector of claim 1, wherein said article comprises a glass pane, and said first electrode comprises a wire approximately 0.50 (12.7 mm) inches in length and 0.030 (0.762 mm) inches in diameter and adapted for resonating at a particular frequency component of the sound produced by the breaking of said pane.

6. The detector of claim 5, wherein said wire includes a contact spike extending from a medial portion thereof.

7. The detector of claim 1 wherein said housing is manually rotatable on said base plate to select the appropriate orientation and sensitivity of said switch.

8. The device of claim 1, wherein said housing is filled with a potting compound.

9. The device of claim 4, including a hole in said housing through which a cable extends to said switch, said cable disposed between said fingers and the interior peripheral wall of said housing.

* * * * *